US008727663B2

(12) United States Patent
Chilloux et al.

(10) Patent No.: US 8,727,663 B2
(45) Date of Patent: May 20, 2014

(54) CAPTURE AND STORAGE INSTALLATION FOR HYDROCARBONS ESCAPING AN UNDERWATER WELL

(75) Inventors: David Chilloux, Fleury les Aubrais (FR); Francois Thiebaud, Saint Cyr Sous Dourdan (FR)

(73) Assignee: Doris Engineering, Paris (FR)

( * ) Notice: Subject to any disclaimer, the term of this patent is extended or adjusted under 35 U.S.C. 154(b) by 153 days.

(21) Appl. No.: 13/307,664

(22) Filed: Nov. 30, 2011

(65) Prior Publication Data

US 2012/0141206 A1 Jun. 7, 2012

(30) Foreign Application Priority Data

Dec. 1, 2010 (FR) ..... 10 59976

(51) Int. Cl.
*B63G 8/42* (2006.01)

(52) U.S. Cl.
USPC ..... 405/60; 114/257

(58) Field of Classification Search
USPC ..... 405/60–64, 210, 224–228; 166/364; 114/256, 257
See application file for complete search history.

(56) References Cited

U.S. PATENT DOCUMENTS

| | | | | |
|---|---|---|---|---|
| 3,113,699 | A * | 12/1963 | Crawford et al. | 222/23 |
| 3,503,443 | A * | 3/1970 | Trageser et al. | 166/344 |
| 3,724,662 | A * | 4/1973 | Ortiz | 405/65 |
| 4,320,991 | A * | 3/1982 | Rogers | 405/68 |
| 4,358,218 | A | 11/1982 | Graham | |
| 5,820,300 | A * | 10/1998 | Sonoda et al. | 405/188 |
| 6,739,274 | B2 * | 5/2004 | Eagles et al. | 114/74 T |
| 7,448,404 | B2 | 11/2008 | Samuelsen et al. | 137/236.1 |
| 7,882,794 | B2 | 2/2011 | Baylot et al. | |

FOREIGN PATENT DOCUMENTS

| | | |
|---|---|---|
| FR | 2 852 917 | 10/2004 |
| GB | 2 242 220 A | 9/1991 |

* cited by examiner

*Primary Examiner* — Frederick L Lagman
*Assistant Examiner* — Kyle Armstrong
(74) *Attorney, Agent, or Firm* — Davidson, Davidson & Kappel, LLC

(57) ABSTRACT

An installation is provided. The installation includes a plurality of tanks, each tank including a filling opening and being adapted to be arranged on the sea bottom around the well and a device for capturing and distributing hydrocarbons escaping the well. The device includes a bell, a positioner for positioning the bell above the well and a connector for selectively connecting an apex of the bell to the filling opening of any one of the tanks in a fluid manner so as to transfer the fluid into that opening. The invention is applicable to uncontrolled eruptions of offshore oil wells.

13 Claims, 9 Drawing Sheets

CAPTURE AND STORAGE INSTALLATION FOR HYDROCARBONS ESCAPING AN UNDERWATER WELL

Priority is hereby claimed to FR 10 59976 filed on Dec. 1, 2010, the entire disclosure of which is hereby incorporated by reference herein.

The present invention relates to a capture and storage installation for hydrocarbons escaping an underwater well.

The invention applies to hydrocarbon recovery on an uncontrolled oil and gas eruption site.

BACKGROUND

A recent accident in the Gulf of Mexico revealed the difficulty of controlling and stopping an erupting underwater oil well, when a confinement system cannot contain the pressure from the well. Furthermore, in such a situation, capturing and bringing up the fluid is pointless without adequate support on the surface, while the surface means necessary to treat an oil effluent are difficult to mobilize quickly on-site.

U.S. Pat. No. 7,448,404 describes an underwater hydrocarbon storage installation including a plurality of tanks. However, this installation is not adapted for intervening on an accidental hydrocarbon leak. In fact, it involves a heavy rigid structure, difficult to deploy quickly and requiring dedicated vessels, which are generally not available on the site of an offshore oil accident. Furthermore, all of the tanks are connected in parallel to a supply pipe by bleeds provided with valves, and said bleeds risk becoming plugged quickly due to the formation of hydrates resulting from cooling of the oil-gas-water mixture coming from the erupting well.

SUMMARY OF THE INVENTION

An object of the present invention provides an installation making it possible to capture and store, at the bottom of the sea at a great depth, erupting fluid for a period of several days to several weeks, or more, while waiting to be able to process it on the surface, the installation being relatively inexpensive and being able to be deployed easily and quickly by an vessel of opportunity, of the towboat type, generally able to be mobilized in one or two days.

The present invention provides an installation for capturing and storing hydrocarbons escaping from an underwater well, characterized in that it comprises a plurality of tanks each including a filling opening and adapted to be arranged on the sea bottom around the well and a device for capturing and distributing hydrocarbons escaping the well. The device includes a bell, means for positioning the bell above the well and transfer means for selectively connecting the apex of the bell to the filling opening of any one of the tanks in a fluid manner so as to transfer the fluid into that opening.

According to other features of this installation, the installation may include one or more of the following features:

- the transfer means comprises a pipe provided at its free end with an output orifice adapted to be fluidly connected to the filling opening of any one of the tanks so as to transfer the fluid into that opening;
- said pipe forms a rigid gooseneck connected to the apex of the bell by a swing joint;
- the filling opening of each tank is equipped with a funnel open downwardly, and the output orifice of said pipe is provided on the upper generatrix of the pipe and is adapted to be arranged selectively under the funnel of each tank;
- each tank may comprise:

- an inflatable bladder with a very elongate shape provided with said filling opening at one end and connecting members to at least one cable; and
- at least one cable extending over at least the largest length of the bladder and connected thereto using said connecting members;
- the bladder comprises a plurality of compartments secured to each other and communicating with each other by passages;
- the bladder comprises at least two longitudinal portions extending on either side of a cable and folded one on the other in the standby position of the bladder;
- the bladder comprises a central portion bordered by two cables and framed by two side portions folded on the central portion in the standby position of the bladder;
- the bladder comprises frangible connections for keeping the bladder in the folded down position;
- the installation comprises a drum on which each folded bladder is wound in the standby position;
- the bladder is equipped, on its upper surface, with at least one connector, and each bladder also comprises a compensating balloon adapted to be connected to said connector;
- the or each cable is provided at each end with a connector for connecting to another cable;
- each bladder comprises a series of connections adapted to connect the or each cable to moorings; and
- each bladder comprises chains adapted to be connected to the or each cable.

BRIEF DESCRIPTION OF THE DRAWINGS

One embodiment of the invention will now be described in light of the appended drawings, in which.

DETAILED DESCRIPTION

The storage device shown in FIGS. 1 to 5 essentially comprises an inflatable bladder 1 made up of a suitable material, in particular an elastomer or a polyurethane, possibly reinforced with a geotextile layer. Said bladder constitutes, with its accessories that will be described below, a tank R.

Figure 16:
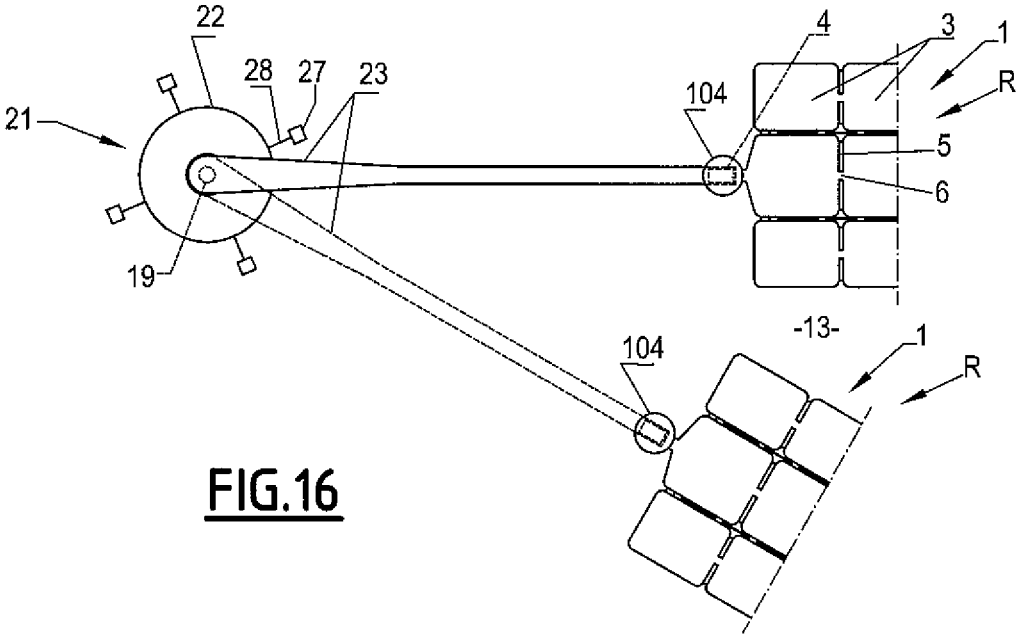
FIG. 16 is a planar view of the object of FIG. 15.

The bladder 1 has a very large length and is made up of three juxtaposed strings 2 of compartments 3. All of the compartments 3 communicate with each other, so that the bladder can be completely inflated from a filling opening 4 provided at one of its ends, visible in FIG. 16. The opening 4 is equipped with a funnel 104 open downwardly.

Each compartment 3 is connected by welding and/or sewing to the adjacent compartments by flat strips 5, at certain points of which communication passages or tunnels 6 with large diameters are provided.

As is well known, offshore eruptions are generally made up of a mixture of oil, gas and water at a high pressure (around 100 to 300 bars) and high temperature (around 50 to 80° C.). Upon cooling in contact with the sea water and due to the relaxation, the viscosity of the oil increases and it can even congeal; the gas, in the presence of water, can form hydrate crystals (similar to ice crystals) that tend to plug the channels or channel constrictions. As a result, the diameter of the passages 6 is chosen to be large enough to prevent any risk of plugging by the hydrates.

As an example of dimensions:

- the central string 2A is slightly wider than the side strings 2B: around 10 m versus around 8 m;
- all of the compartments 3 have the same length, comprised between 8 and 10 m;
- the bladder comprises thirty regions of three compartments, that is a total length of about 250 to 300 m;
- once inflated (FIGS. 2 to 5), the thickness of the bladder is comprised between 3 and 5 m;
- the passages 6 have a diameter of about 1 m or more.

Thus, the storage capacity of a bladder 1 is in the vicinity of 100,000 barrels (15,900 $m^3$).

Figure 9:
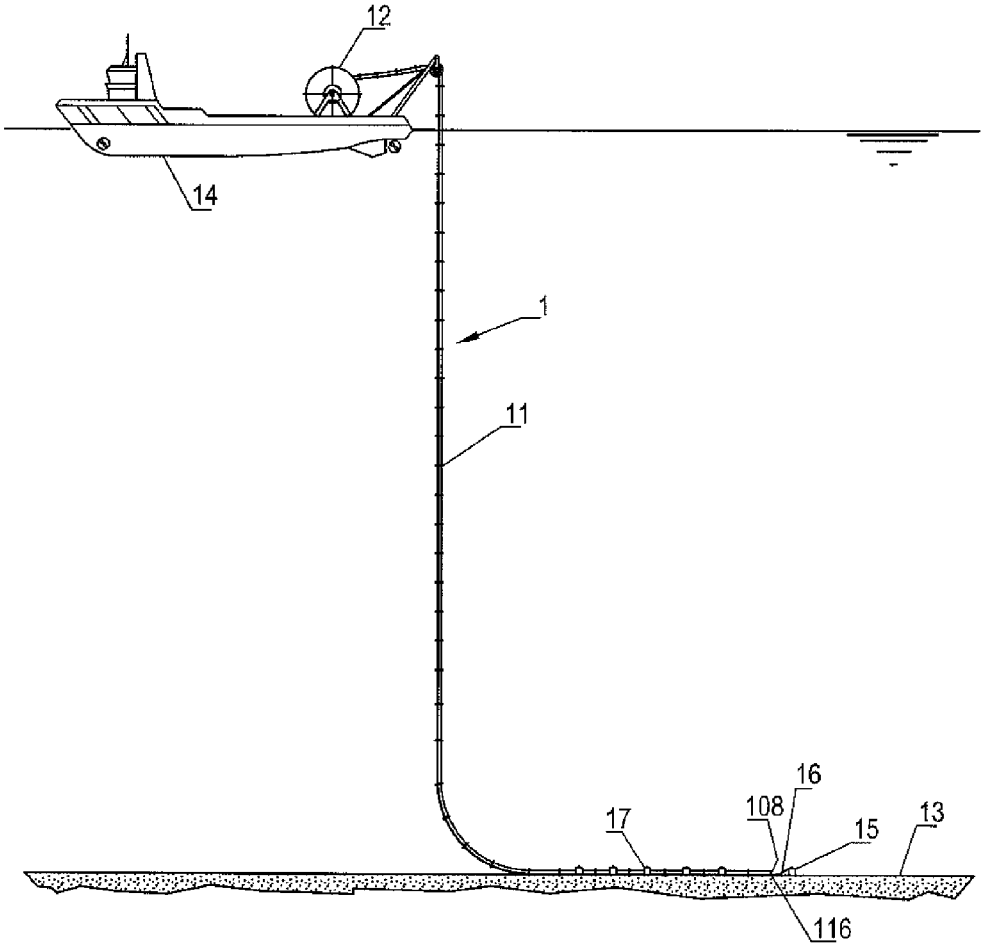
FIG. 9 diagrammatically illustrates the placement of the bladder on a sea bottom.
Figure 10:
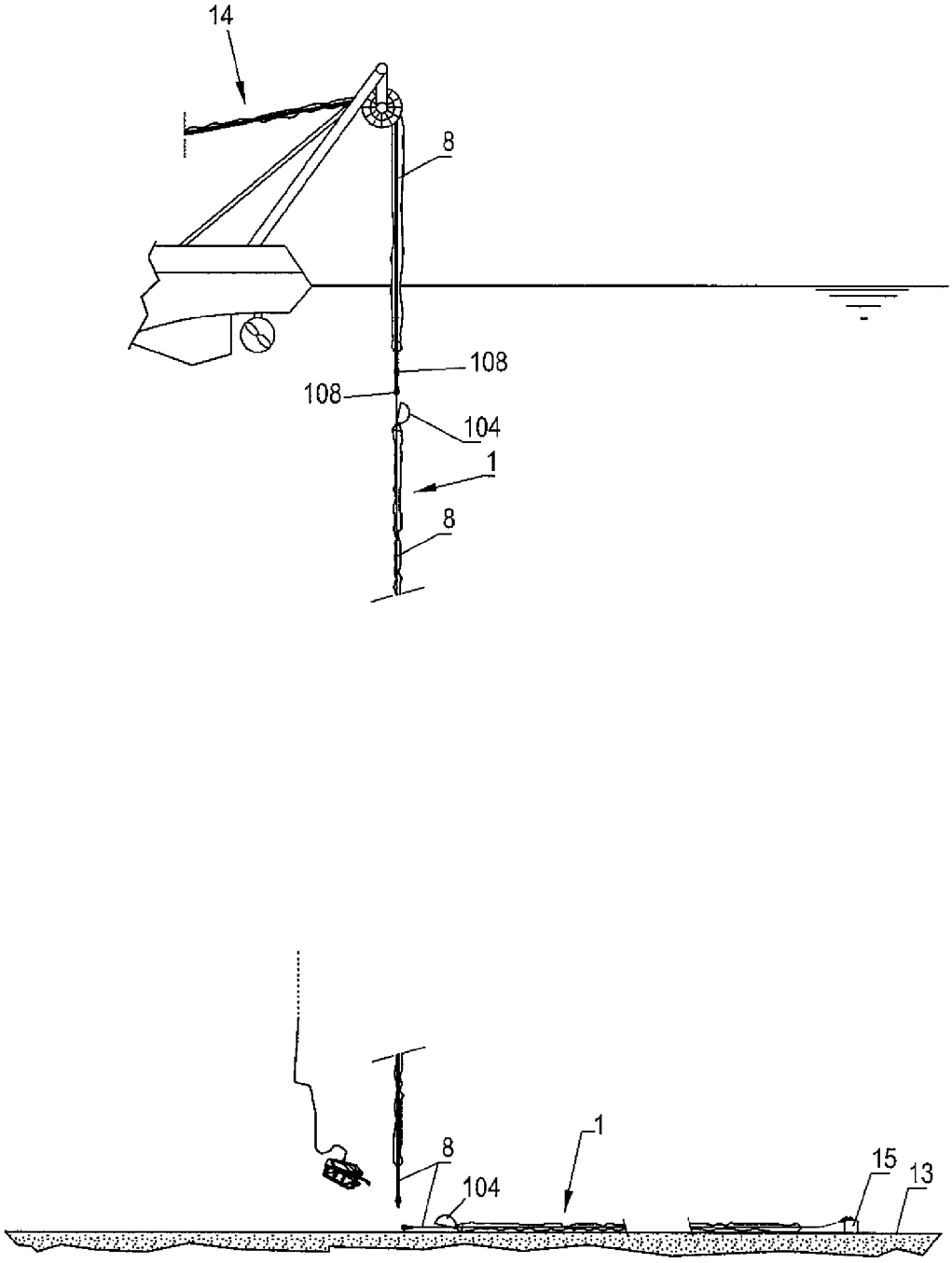
FIG. 10 shows a similar illustration of consecutive bladders on the sea bottom.

The bladder is completed by valve bridges 7 arranged under the two longitudinal strips 5 at a rate of two valve bridges per compartment 3. The valve bridges 7 are formed by strips made of the same flexible material as the bladder and welded/sewed thereto by their ends. A cable 8 is slipped into each series of valve bridges and protrudes at each end of the bladder, where it is provided with a connecting tip 108 (FIGS. 9 and 10).

The bladder is also completed by a small number of connectors 9 arranged on the upper surface of compartments 3 neighboring the ends of the bladder.

The total mass of such a bladder and its two cables is in the vicinity of 135 tons.

Figure 1:
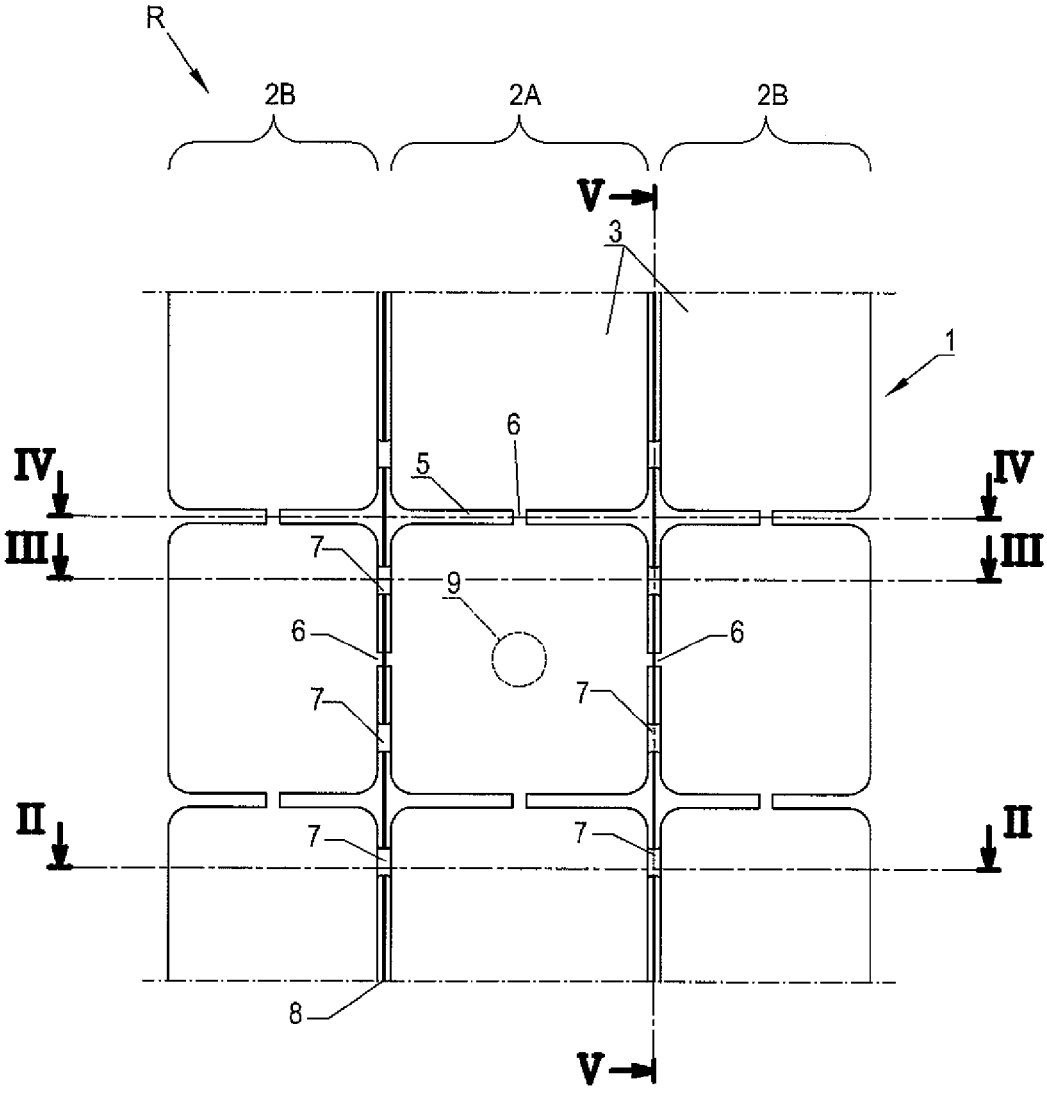
FIG. 1 is a planar view of a storage device according to the invention.
Figure 2:
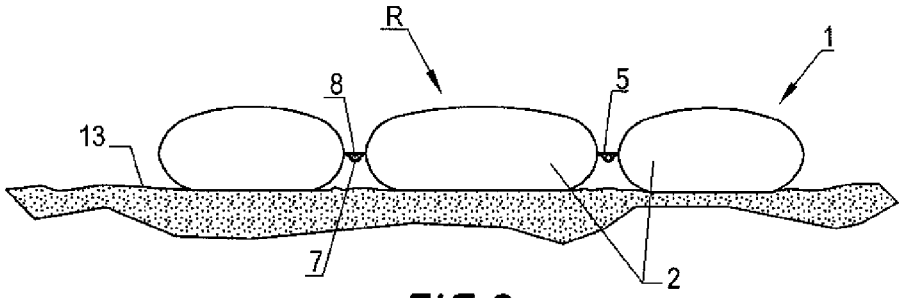
FIGS. 2 to 5 are cross-sectional views along lines II-II to V-V, respectively, of FIG. 1.
Figure 3:
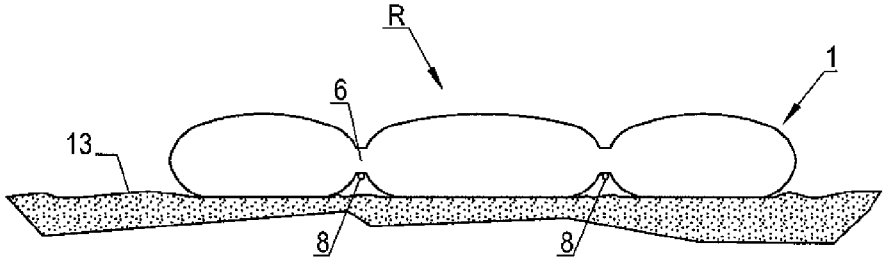
Figure 4:
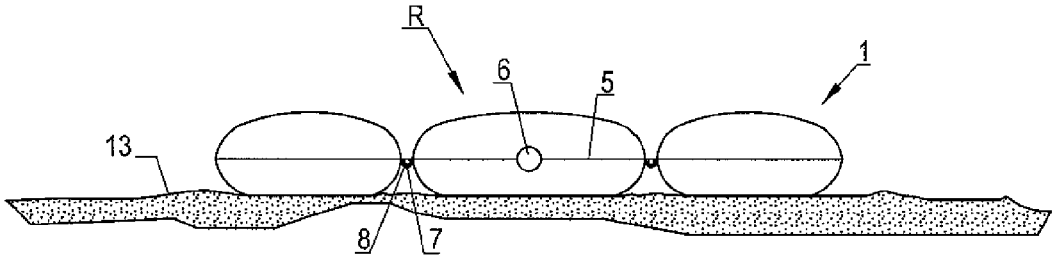
Figure 5:
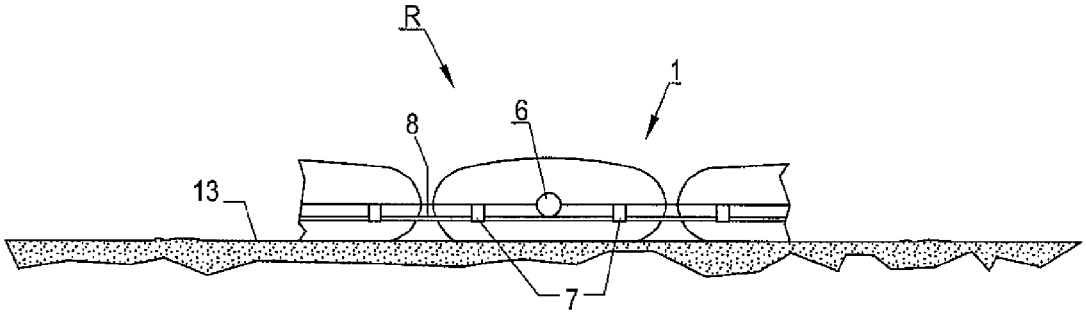
Figure 6:
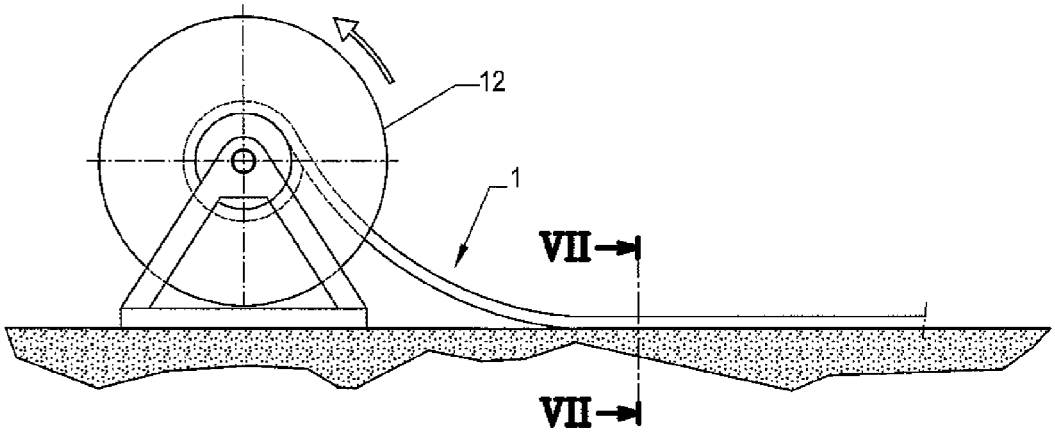
FIG. 6 diagrammatically illustrates, in side view, a drum on which a bladder is wound as shown in FIGS. 1 to 5.
Figure 7:
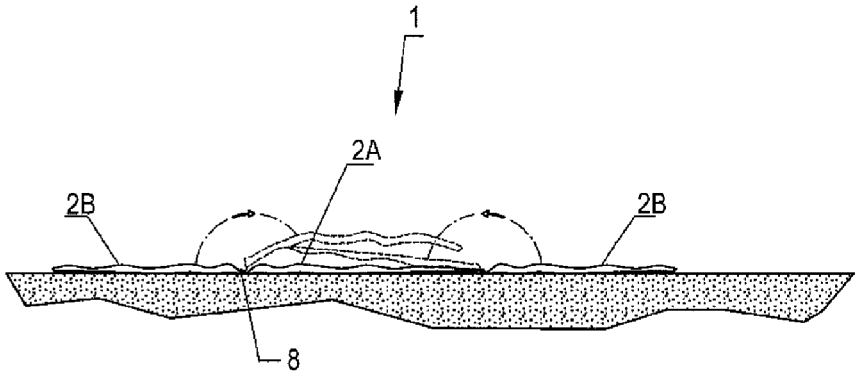
FIG. 7 is a cross-sectional view along line VII-VII of FIG. 6.
Figure 8:
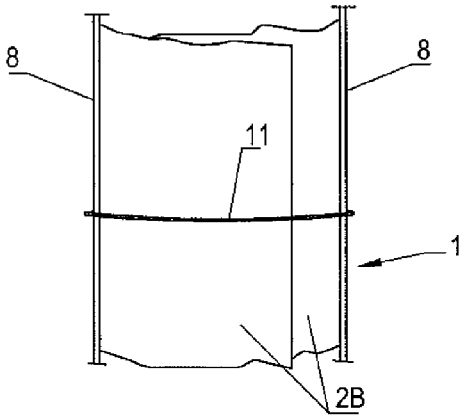
FIG. 8 is a partial top view of the subject matter of FIG. 7.

To store the bladder and place it on standby, the two side strings 213 thereof are folded on the middle string 2A (FIGS. 7 and 8), and are maintained by frangible connections 11 (FIG. 8). Thus, the two cables 8 are visible on each side. The assembly is then wound on a drum 12 (FIG. 6).

Figure 11:
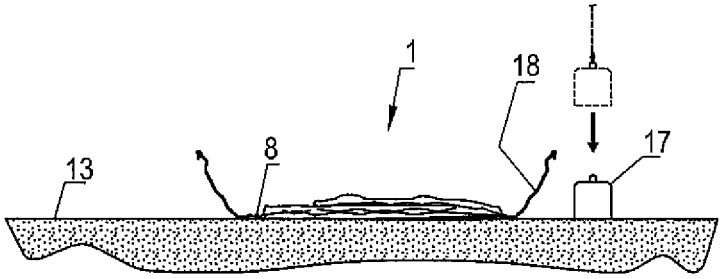
FIGS. 11 to 13 diagrammatically illustrate the maintenance in position of a bladder on the sea bottom.

FIGS. 9 to 11 illustrate the placement of the bladder 1 on a sea bottom 13 at a great depth (typically 1,000 m or more).

The drum 12 supporting the bladder 1 is placed onboard a towboat 14 or another easily available vessel. The onboard mass is in the vicinity of 170 tons, which makes it possible to load it with handling means commonly available in an oil port.

A mooring 15 is arranged at a suitable location on the bottom 13, said mooring being connected to one end of two parallel initiation cables 16 each provided with connecting tip 116.

The bladder 1 is lowered, under the effect of its own weight, to the mooring 15, and each of its cables 8 is connected to the free end of the corresponding cable 16 by a ROV (Remote Operated Vehicle) using the tips 108 and 116.

Figure 12:
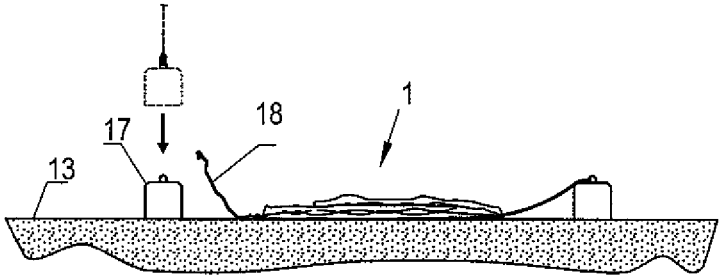
Figure 13:
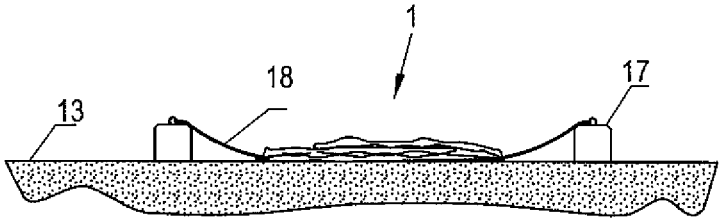

Then (FIGS. 11 and 12), side moorings 17 are arranged on either side of the bladder and are connected to the two cables 8 by lightened towing chains 18, at chosen spaces along the bladder.

Figure 14:
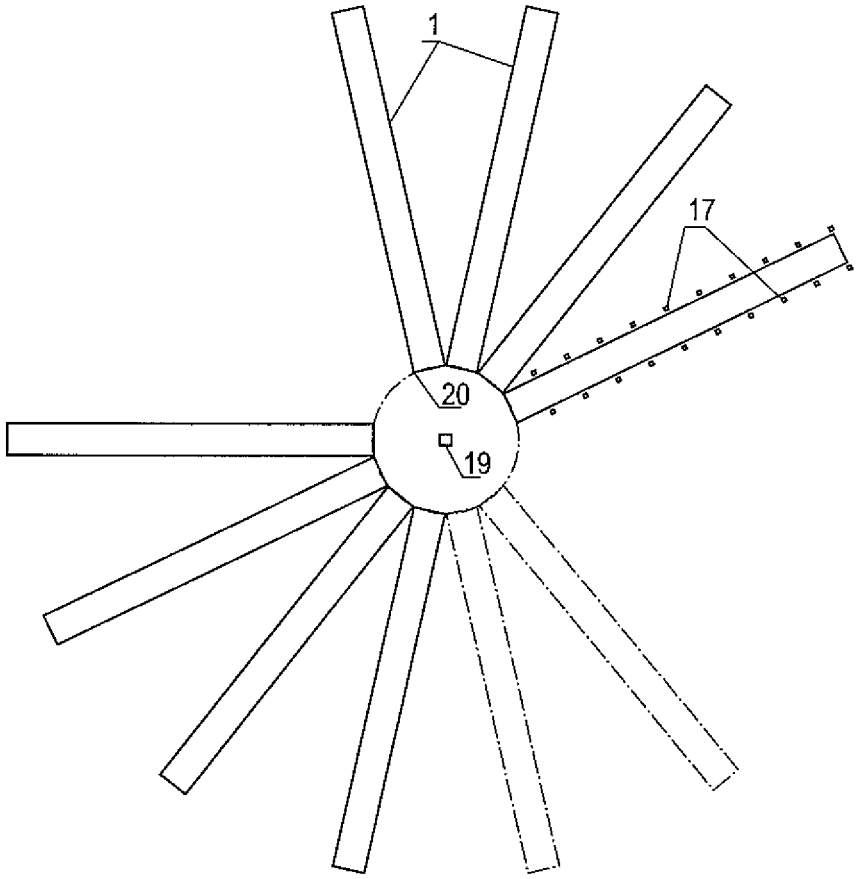
FIG. 14 diagrammatically illustrates, in planar view, the arrangement of multiple similar bladders around an underwater wellhead experiencing an uncontrolled eruption.

To dam an uncontrolled eruption of an offshore wellhead 19 (FIG. 14), a plurality of bladders 1 are arranged radiating or "in petals" around the wellhead, with their filling ends situated on a circle 20 centered on the wellhead. The radius of the circle 20 is typically several tens of meters, for example 60 m. Of course, beforehand, the same number of turntables 12 as petals are placed onboard on the vessel 14.

To that end, when a bladder 1 has been completely unwound from the drum 12 temporarily motorized to power on and ensure the reversibility of the lowering operation; the following bladder is attached thereto using the tips 108 of four cables (FIG. 10). When the first bladder has been completely placed on the bottom 13, the following bladder is unhooked, and its lower end is moved to the mooring 15 associated with it.

Figure 15:
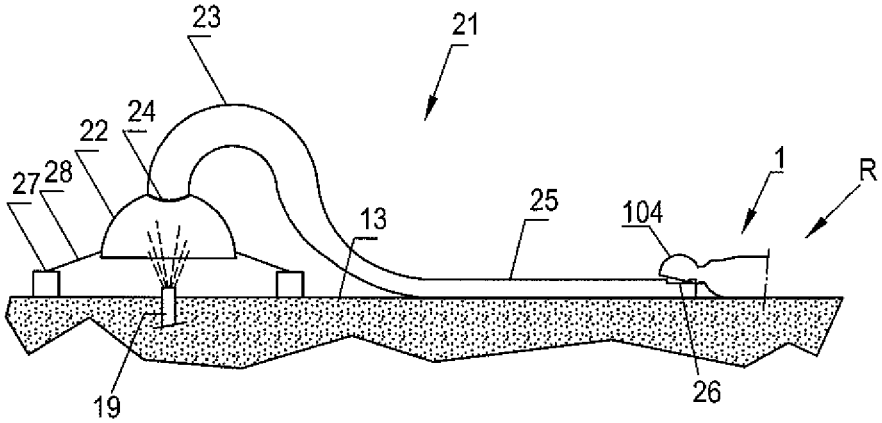
FIG. 15 shows a bell for capturing and distributing hydrocarbons escaping the well.

Then (FIGS. 15 and 16), a hydrocarbon capture and distribution device 21 is lowered to the wellhead 19. This device 21 comprises a bell 22 from the apex of which a rigid gooseneck 23 starts. The latter is pivotably mounted on the bell 22 using a swivel joint 24, and its free end portion 25 is horizontal and provided on its upper generatrix with an outlet orifice 26. Said orifice is situated at a distance from the wellhead 19 equal to the radius of the circle 20.

The bell 22 is kept in position using a positioner which may include several moorings 27 arranged in a circle around the wellhead and each connected to the periphery of the bell by a towing chain 28. The bell can float or be weighed down, and in that case placed on a stabilizing structure (legs+cushion).

In use, the orifice 26 is arranged under the funnel 104 of a first bladder 1 by a ROV. The oil-gas-water mixture leaving the wellhead at high pressure and high temperature is confined by the bell 22 and oriented into the gooseneck 23. It emerges therefrom via the orifice 26 and thereby penetrates the bladder. The latter starts to inflate and deploy flat owing to the rupture of the connections. This inflation spreads from compartment 3 to compartment 3 as long as the captured mixture is not congealed.

When the bladder is completely filled or stops filling, the ROV makes the gooseneck 23 pivot until the orifice 26 is located below the funnel 104 of the following bladder.

For a leak of 100,000 barrels per day, one sees that each bladder can collect substantially one day of leakage, because when such a substantial flow rate, the cooling of the mixture is relatively slow. As a result, with fourteen bladders, it is possible to collect two weeks of fluid, which leaves the same amount of time to cover the well.

If the flow rate is lower, each petal fills more slowly, and possibly incompletely due to the faster cooling of the fluid.

Figure 17:
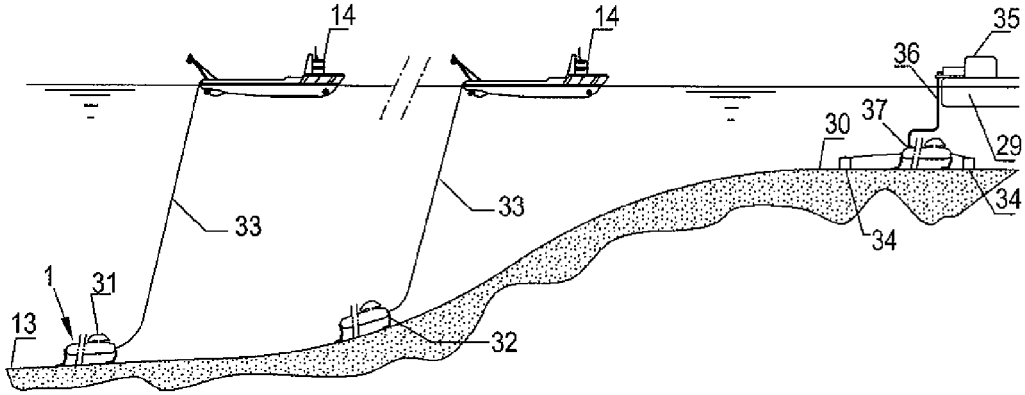
FIG. 17 diagrammatically illustrates the recovery of a filled bladder.
Figure 18:
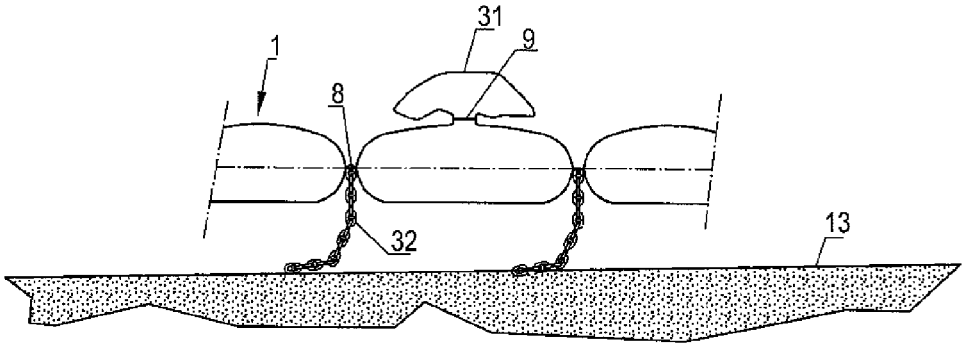
FIG. 18 is a corresponding detail view.

FIGS. 17 and 18 illustrate the recovery of the bladders after they are filled. This recovery can occur several days, or even several weeks later, when a hydrocarbon treatment vessel 29 can be brought to a bottom 30 that is shallower (for example 100 m) in a neighboring region of the well 19.

To that end, each petal containing cold oil can be towed at a shallow depth in the "off-bottom tow" configuration. One of the difficulties in the recovery lies in the fact when that the oil is brought to a shallow depth, the gas relaxes, and part of the gas dissolved in the liquids leaves the liquid phase and takes up a more significant space. Thus, the passage from 1,000 m deep to 500 m deep results in a doubling of the gas volume. From 1,000 m to 100 m deep, the volume of gas is multiplied by 10, but from 1,000 m to the surface, it is multiplied by 100.

That is why it is preferable to tow the bladders above the bottom 30 without returning them to the surface.

To that end, a compensating balloon 31, forming an attached bladder, is fastened on a connector 9 of the bladder situated close to the top point thereof. Chains 32 are fixed to the cables 8 in place of at least one portion of the moorings 15 and 17, the assembly having an equivalent weight. The recovered mixture being lighter than water, the bladder stays at a small distance above the bottom 13, as shown in FIG. 18.

A towing chain 33 is then hooked to the bladder 1, which is pulled by the vessel 14 while rising to the bottom 30. During that movement, the spacing of the bladder above the bottom prevents any deterioration, and the gas that is freed and relaxes gradually fills the balloon 31, facilitating the rise of the bladder.

When the bottom 30 is reached, the bladder is stabilized using moorings 34, and the vessel 29, provided with oil treatment equipment 35 and a riser for the oil product 36, is anchored nearby. The riser 36 is connected on a clip 37 situated at one end or in several locations of the petal to allow the light oil to rise naturally. A pumping system can also be lowered into the riser to activate the fluid.

As will be understood, if the hydrocarbon leak is not controlled when all of the bladders are filled, it is possible to continue the recovery operation by moving the bladders away from each other in the manner indicated above and depositing new, empty bladders on the bottom 13.

What is claimed is:

1. An installation for capturing and storing hydrocarbons escaping from an underwater well comprising:

a plurality of tanks each including a filling opening and adapted to be arranged on a sea bottom around the underwater well; and a device for capturing and distributing hydrocarbons escaping the well, the device comprising:

a bell;

a positioner for positioning the bell above the well; and a connector for selectively connecting an apex of the bell to the filling opening of any one of the tanks in a fluid manner so as to transfer the fluid into that opening, the connector including a pipe provided at a free end with an output orifice adapted to be fluidly connected to the filling opening of any one of the plurality of tanks so as to transfer fluid into that opening, wherein each tank includes:

an inflatable bladder with an elongated shape provided with the filling opening at one end and connecting members; and at least one cable extending over at least the largest length of the bladder and connected thereto using the connecting members, wherein the bladder includes at least two longitudinal portions extending on either side of the at least one cable, the longitudinal portions being folded on one another in a standby position of the bladder.

2. The installation according to claim 1, wherein the pipe forms a rigid gooseneck connected to the apex of the bell by a swing joint.

3. The installation according to claim 1, wherein the filling opening of each of the plurality of tanks includes a funnel open towards the sea bottom, and the output orifice of the pipe is provided on the upper generatrix of the pipe and is adapted to be arranged selectively under the funnel of each tank.

4. The installation according to claim 1, wherein the bladder includes a plurality of compartments secured to each other and communicating with each other by passages.

5. The installation according to claim 1, wherein the bladder includes a central portion bordered by two cables and framed by two side portions folded on the central portion in the standby position of the bladder.

6. The installation according to claim 1, wherein the bladder includes frangible connections for keeping the bladder in the folded down position.

7. The installation according to claim 1, further comprising a drum on which each folded bladder is wound in the standby position.

8. The installation according to claim 1, wherein the bladder includes, on an upper surface, at least one bladder connector, and in that each bladder also includes a compensating balloon adapted to be connected to the at least one bladder connector.

9. The installation according to claim 1, wherein the at least one or each cable is provided at each end with a cable connector for connecting to another cable.

10. The installation according to claim 1, wherein each bladder includes a series of connections adapted to connect the at least one or each cable to moorings.

11. The installation according to claim 1, wherein each bladder includes chains adapted to be connected to the at least one or each cable.

12. The installation according to claim 1 wherein the positioner includes at least one mooring.

13. The installation according to claim 1 wherein the positioner includes at least one tow chain.

* * * * *